US006060797A

United States Patent [19]

Harris et al.

[11] Patent Number: 6,060,797

[45] Date of Patent: May 9, 2000

[54] SOLENOID OPERATED REMOTE RESETTING DEVICE WITH A PROTECTIVE ACTIVATION CIRCUIT

[75] Inventors: Matthew R. Harris, Raleigh; Gregory R. Lawrence, Wilson; Timothy B. Phillips, Raleigh, all of N.C.

[73] Assignee: Square D Company, Palatine, Ill.

[21] Appl. No.: 08/960,552

[22] Filed: Oct. 31, 1997

Related U.S. Application Data

[63] Continuation-in-part of application No. 08/424,770, Apr. 18, 1995, abandoned.

[51] Int. Cl.[7] ..... H01H 3/02; H01H 9/02; H01H 75/02

[52] U.S. Cl. ..... 310/14; 310/30; 361/152; 361/154; 361/195; 335/14; 335/20

[58] Field of Search ..... 361/152, 154, 361/196, 195; 310/14; 335/14, 20, 30

[56] References Cited

U.S. PATENT DOCUMENTS

| | | | |
|---|---|---|---|
| 3,215,864 | 11/1965 | Doyle et al. | 327/393 |
| 3,577,040 | 5/1971 | Campbell | 361/154 |
| 3,753,173 | 8/1973 | Goldberg | 335/1 |
| 3,893,050 | 7/1975 | Salvati et al. | 335/1 |
| 4,446,500 | 5/1984 | Grenier et al. | 361/103 |
| 4,449,161 | 5/1984 | Kling | 361/152 |
| 4,500,938 | 2/1985 | Dulin | 361/153 |
| 4,642,726 | 2/1987 | Matsko et al. | 361/198 |
| 5,289,148 | 2/1994 | Siglock et al. | 335/202 |
| 5,486,972 | 1/1996 | Taylor | 361/154 |
| 5,719,738 | 2/1998 | Singer et al. | 361/196 |

FOREIGN PATENT DOCUMENTS

| | | | |
|---|---|---|---|
| 2 133 941 | 8/1984 | United Kingdom | 361/195 |

*Primary Examiner*—Nestor Ramirez
*Assistant Examiner*—Karl Tamai
*Attorney, Agent, or Firm*—David R. Stacey; Larry I. Golden; Larry T. Shrout

[57] ABSTRACT

A solenoid operated remote resetting device with a protective solenoid activation circuit is disclosed. The device includes a housing for enclosing and protecting a solenoid with a movable plunger, a movable mechanical operator having an operator arm extending through an opening defined in the housing and a circuit board on which a solenoid activation circuit is mounted. The solenoid activation circuit includes circuitry for protecting the solenoid from overheating due to intentional or unintentional prolonged current flow in the solenoid.

26 Claims, 10 Drawing Sheets

SOLENOID OPERATED REMOTE RESETTING DEVICE WITH A PROTECTIVE ACTIVATION CIRCUIT

This application is a continuation of application No. 08/424,770 filed on Apr. 18, 1995, now abandoned.

Devices operated by solenoids and specifically to circuits for protecting the solenoid from overheating during operation.

It is known to use a solenoid for providing a mechanical operation in response to an electrical signal. Generally the electrical signal is initiated from a location remote to the device being operated by the solenoid. It is also known to initiate the electrical signal by pressing an operator interface device, such as a push button, for a period of time required to cause the desired response. This time period is usually only a fraction of a second. However, the reaction time of most people will be somewhat longer thereby causing current to be applied to the solenoid for a period of time longer than required to produce the desired response. The problem can also occur if the operator interface sticks in the closed position or is held in the closed position for a prolonged period of time thus causing current to be continuously supplied to the solenoid circuit. In other applications, the solenoid can be controlled by a programmable logic controller ("PLC") device which is programmed to initiate operation of the solenoid in response to a predetermined logical condition. If, for any reason, the PLC device should cause a continuous current to flow in the solenoid circuit or should the PLC repeatedly attempt to initiate the solenoid operation, a heat failure of the solenoid would occur. When there are no size constraints on the solenoid, a larger solenoid capable of handling the extended current flow can be used. Small solenoids used in today's solid state devices are more susceptible to heating failures and therefore are at a higher risk of solenoid failure due to heating when current is applied to the solenoid activating circuit for an extended period of time. However, modern solid state devices generally require a small solenoid and further require that the heat dissipated by the solenoid be less than a level that will cause damage to any of the solid state components which are in close proximity to the solenoid. It is therefore desirable to provide a solid state solenoid activation circuit which will provide protection to the solenoid against heat caused failure due to extended current in the solenoid circuit and rapid repeated activation of the solenoid. It is also desirable that this circuit have few components such that it can be assembled on a small printed circuit board and be relatively inexpensive to manufacture.

If the desired operation is not performed in the expected time frame the operator will probably press the button again and again. These repeated operations cause heat to build in the solenoid and can ultimately cause failure of the solenoid.

SUMMARY OF THE INVENTION

It is an object of the present invention to provide a simple solenoid activation circuit of few components which can be easily assembled on a small printed circuit board. It is also an object of the present invention to provide protection against solenoid failure due to heat caused by extended current flow in the solenoid circuit and rapid repeated operation of the solenoid. This protection circuit permits the use of a smaller solenoid which would normally be more susceptible to heat damage. These objects are accomplished by including a timer circuit in the solenoid activation circuit, which, after a time sufficient for the solenoid to perform its intended function, prevents further current from being applied to the solenoid even though power continues to be applied to the solenoid activation circuit. When power is removed from the solenoid activation circuit the circuit will be automatically reset for the next solenoid operation initiated by the operator interface device or PLC device.

Other features and advantages of the invention will become apparent to those skilled in the art upon review of the following detailed description, claims and drawings.

Figure 1:
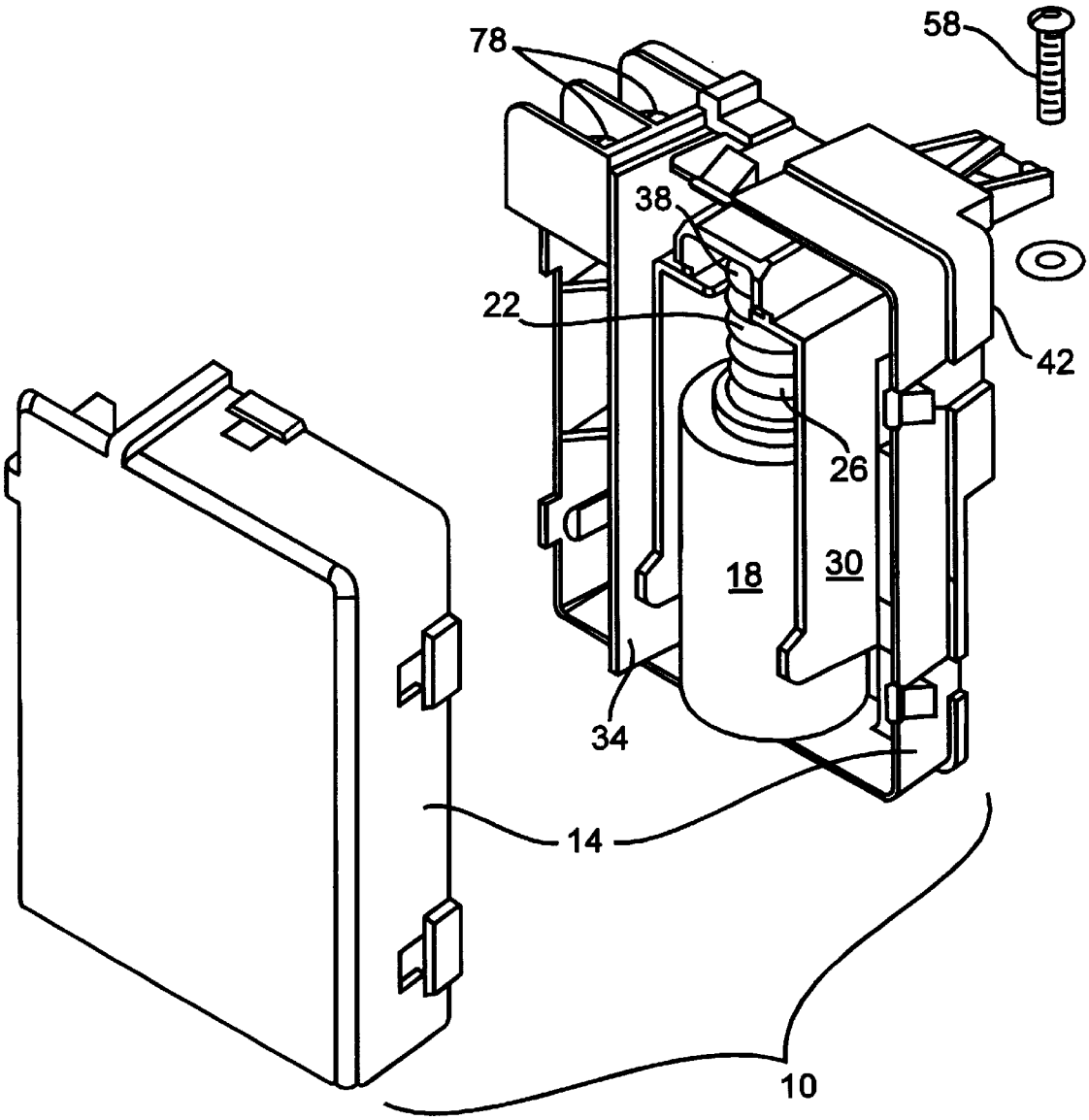
FIG. 1 is an exploded view of a solenoid operated remote mechanical operator device in accordance with the present invention.

Before one embodiment of the invention is explained in detail, it is to be understood that the invention is not limited in its application to the details of construction and description or illustrated in the drawings. The invention is capable of other embodiments and of being practiced or being carried out in various other ways. Also, it is to be understood that the phraseology and terminology used herein is for the purpose of description and should not be regarded as limiting.

DESCRIPTION OF THE PREFERRED EMBODIMENT

Figure 2:
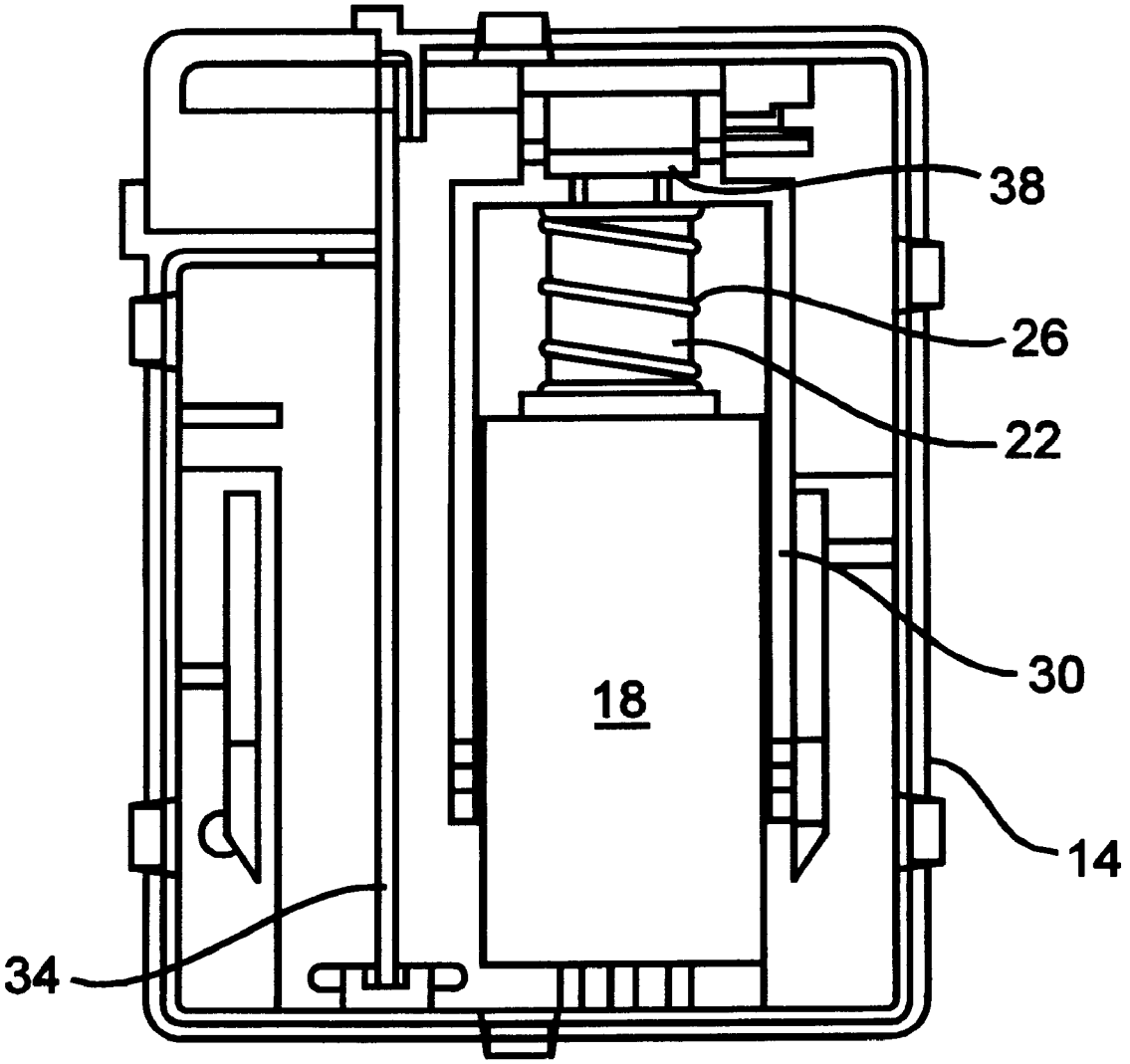
FIG. 2 is a front interior view of a solenoid operated remote mechanical operator in accordance with the present invention.

A solenoid operated remote resetting device 10 in accordance with the present invention is generally illustrated FIG. 1. The remote resetting device 10 includes a housing 14 made from two parts which snap together to define a hollow interior. Enclosed within the housing are a solenoid 18, a solenoid plunger 22, a plunger return spring 26, a mechanical operator 30, and a printed circuit board 34. As shown in FIG. 2, the solenoid 18 and printed circuit board 34 are fixedly held by portions of the housing 14 such that movement is prohibited. The solenoid plunger 22 is normally biased to a first position as shown in FIG. 2 by the return spring 26 and is linearly movable to a second position as shown in FIG. 5 when current is applied to the solenoid 18. Also movably enclosed within the housing 14 is the mechanical operator 30 which is attached to an extending end 38 of the plunger 22 such that the mechanical operator 30 is also movable between a first position shown in FIG. 4 and a second position shown in FIG. 5.

Figure 3:
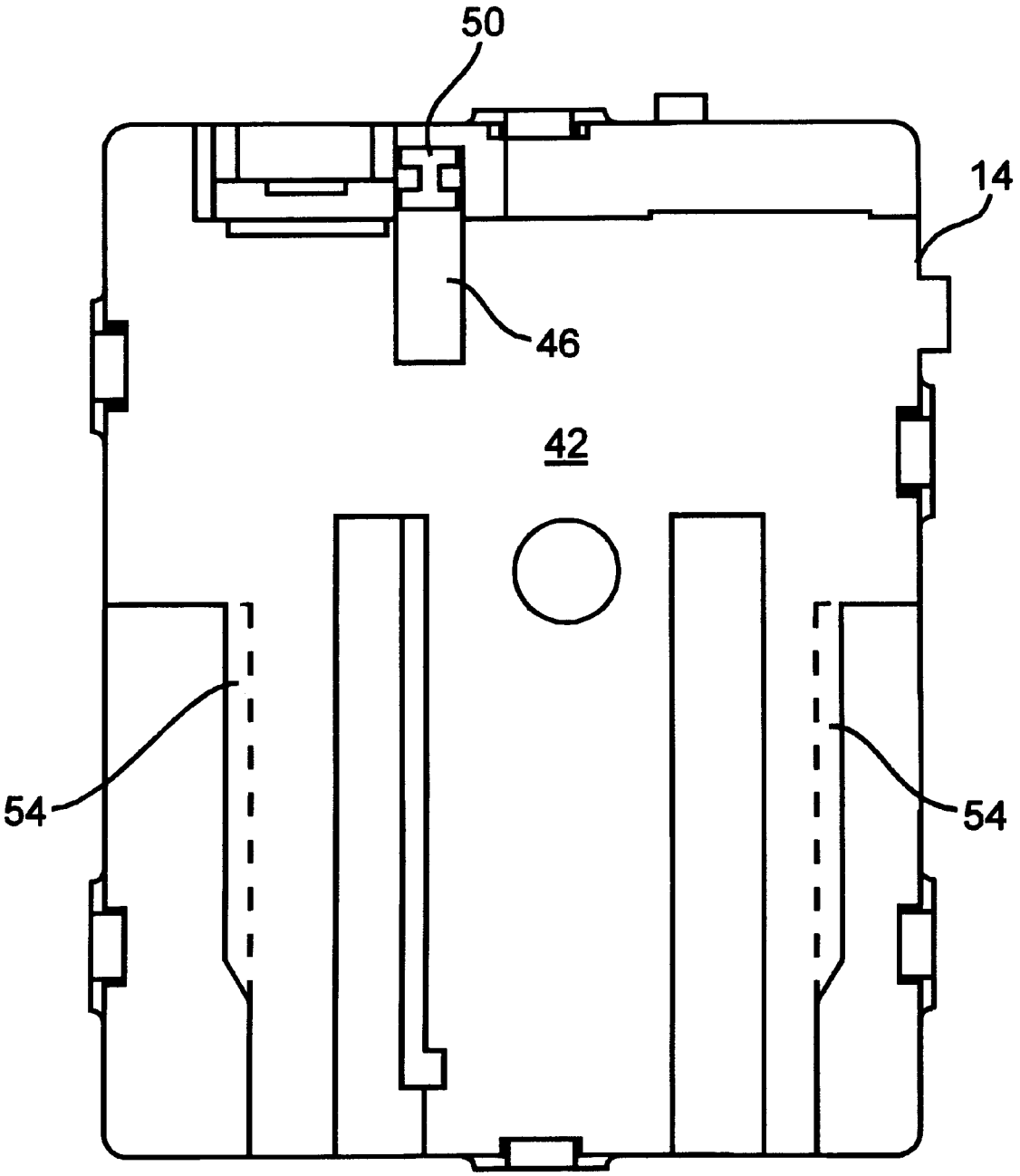
FIG. 3 is a view of the back of a solenoid operated remote mechanical operator in accordance with the present invention.

Referring now to FIG. 3, an operating side of the housing 14, generally indicated by reference numeral 42 is juxtaposed to the device being operated by the solenoid operated remote resetting device 10. A rectangular opening 46 is defined by the housing 14 such that it passes through the operating side 42. The opening 46 receives an operating arm 50 which extends outwardly through the opening 46. The operating arm 50 is an integral part of the mechanical operator 30 and therefore also moves linearly between a first position and a second position. This linear movement corresponds to the movement of the plunger 22 between its first and second positions. Also defined on the operating side 42 of the housing 14 are two generally parallel spaced apart retaining ribs 54. These ribs 54 are slidingly received in two correspondingly spaced apart generally parallel grooves provided in the enclosure of the device to be operated by the solenoid operated remote resetting device 10. The ribs 54 and corresponding grooves provide a means for properly aligning the solenoid operated remote resetting device 10 with the device being operated. A fastener, such as a screw 58 shown in FIG. 1, is used to secure the solenoid operated remote resetting device 10 to the enclosure of the device being operated.

Figure 4:
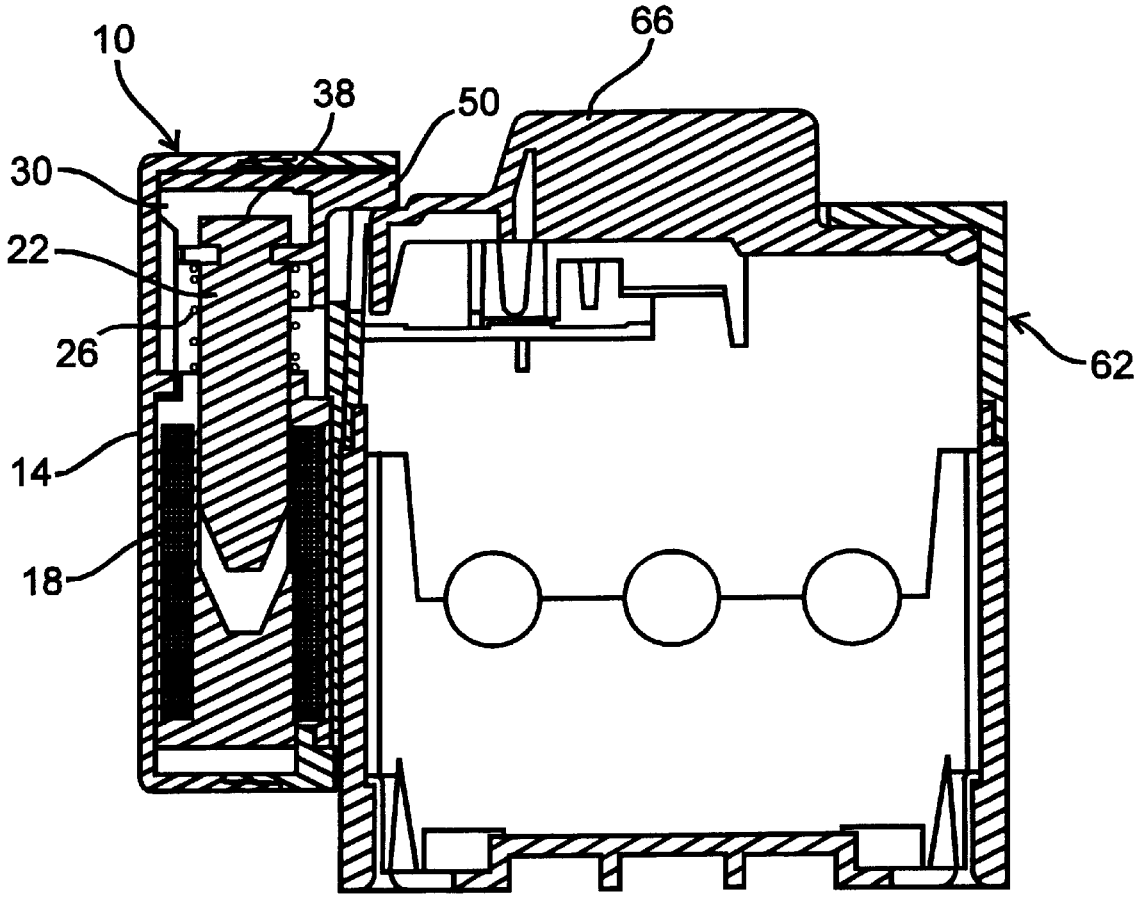
FIG. 4 is a sectionalized view of a solenoid operated remote mechanical operator device showing the solenoid in its normal operating position with respect to a device which it is to operate when activated.
Figure 5:
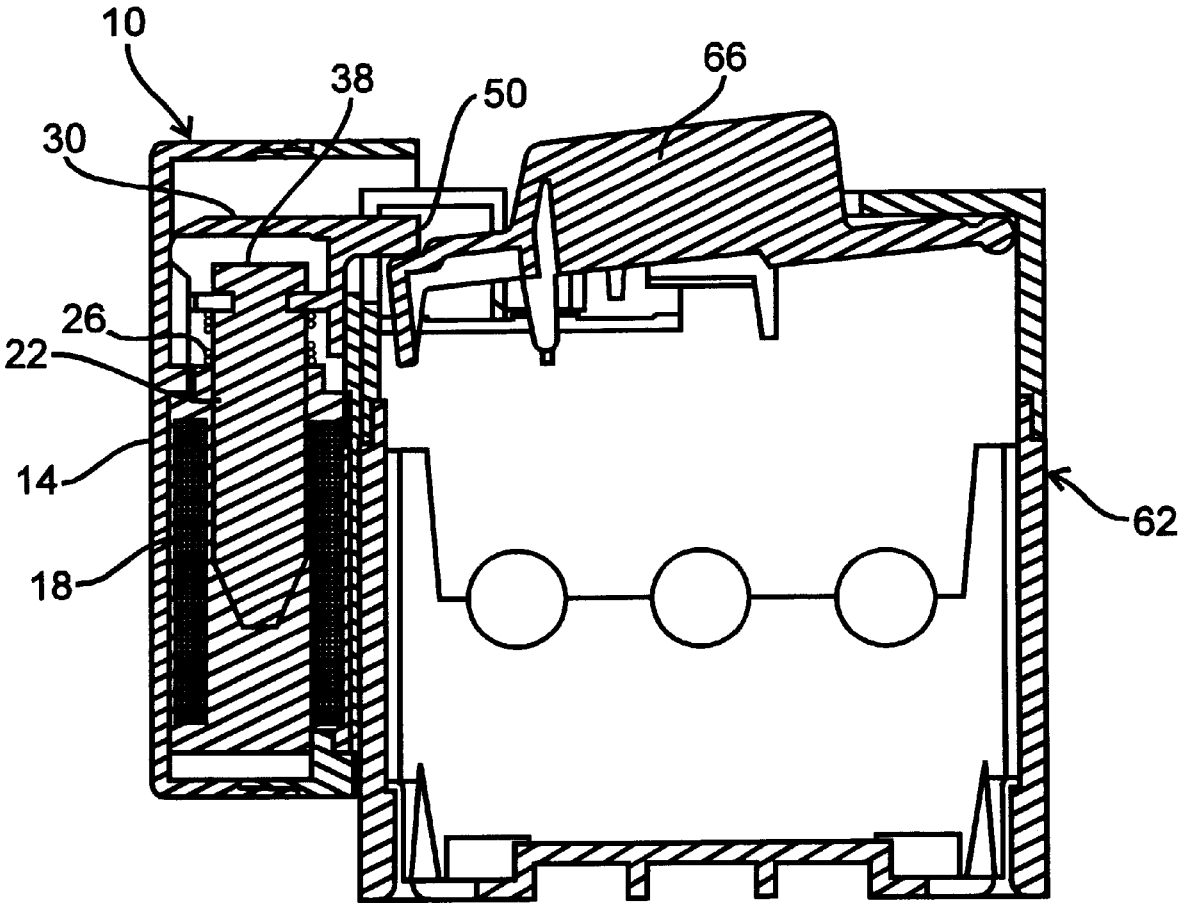
FIG. 5 is a sectionalized view of a solenoid operated remote mechanical operator device showing the solenoid in its activated position with respect to a device which it is to operate when activated.

Referring now to FIGS. 4 and 5 a solenoid operated remote resetting device 10 of the present invention is attached to the housing of an overload protection device generally indicated by reference numeral 62. In FIG. 4 the solenoid plunger 22 is shown in its normally biased first position wherein the operating arm 50 is located immediately adjacent to a manual reset mechanism 66 of the overload protection device 62. In FIG. 5, current has been applied to the solenoid 18 causing the solenoid plunger 22, mechanical operator 30 and operating arm 50 to be moved to their second position. In moving to the second position the operating arm 50 engages the manual reset mechanism 66 causing it to be moved to a reset position and thereby resets the tripped overload protection device 62.

Figure 6:
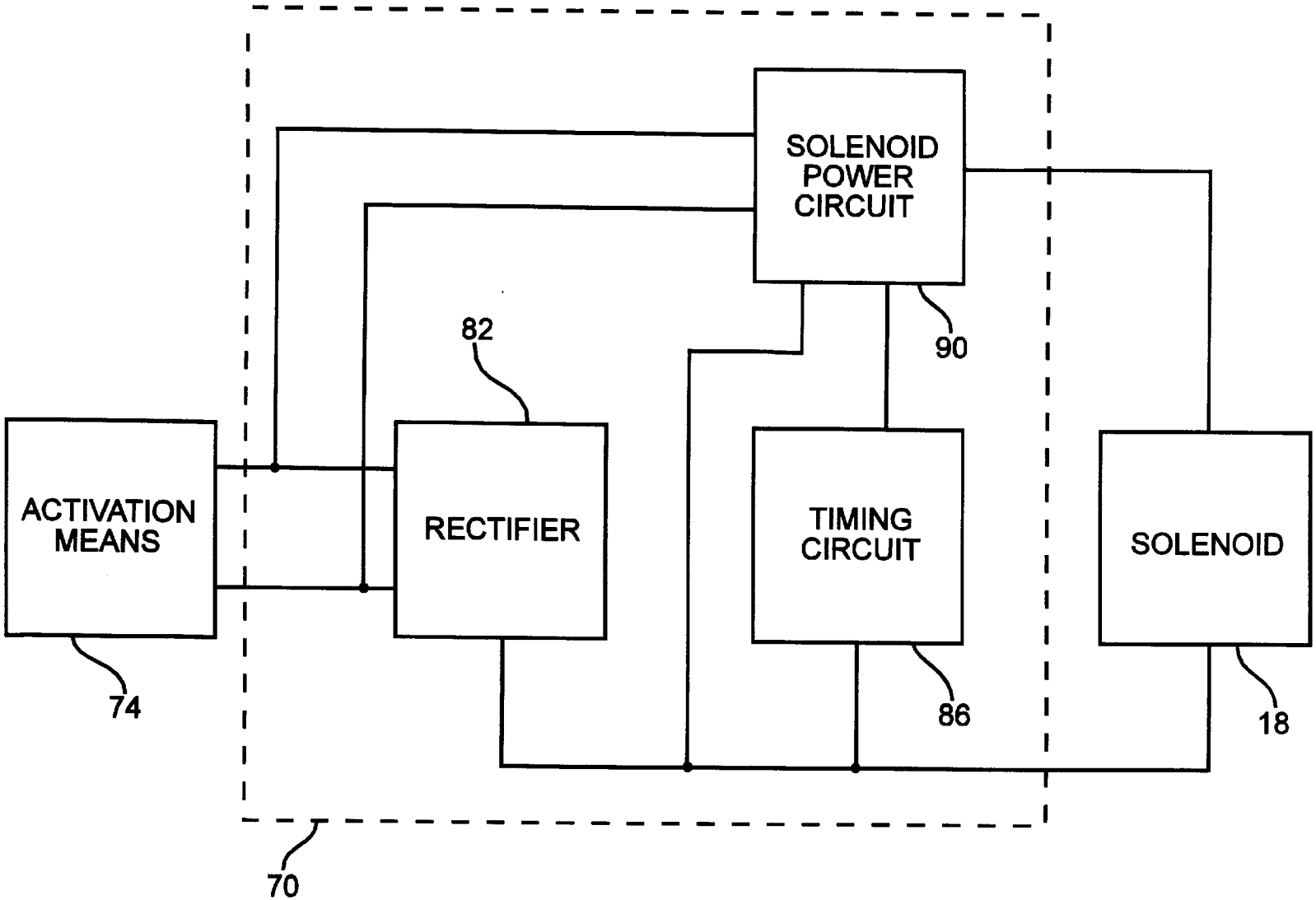
FIG. 6 is a block diagram of a first embodiment of a solenoid activation circuit in accordance with the present invention.

Referring now to FIG. 6, a block diagram of a solenoid activation circuit, generally indicated by reference numeral 70, is shown. Also shown in FIG. 6 is an activation means 74 which includes devices such as a manually operated operator interface device, programmable logic controller or other interposing relays which provide an AC (alternating current) electrical activation signal to the solenoid operated remote resetting device 10. The electrical activation signal is received through a pair of terminals 78 mounted on the housing 14 as shown in FIG. 1. The terminals 78 are electrically connected to the printed circuit board 34. This electrical activation signal provides operating power to a solenoid activation circuit 70. The solenoid activation circuit 70 includes a rectifier 82, a timing circuit 86 and a solenoid power circuit 90.

Figure 7:
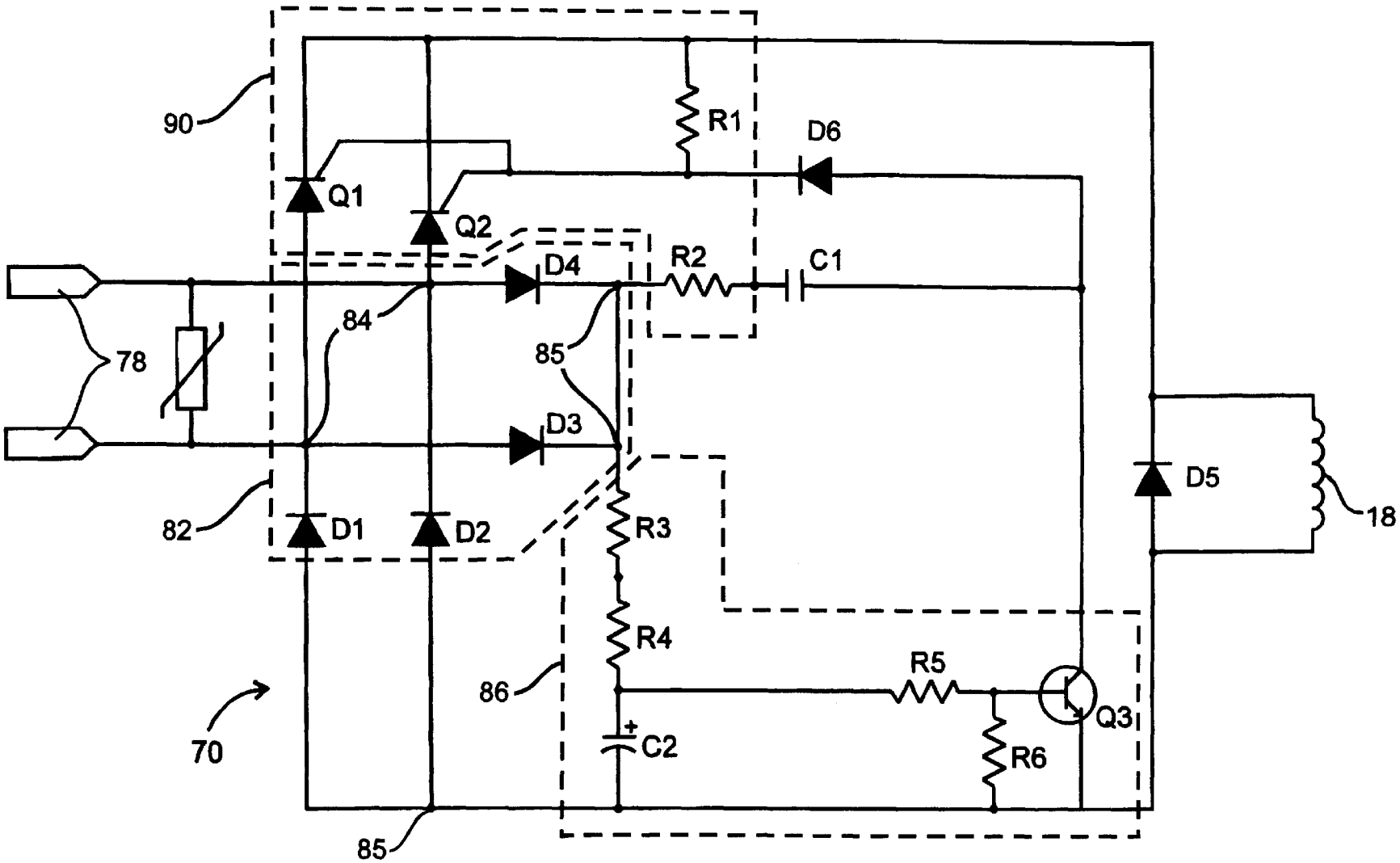
FIG. 7 is a circuit diagram of the first embodiment of a solenoid activation circuit in accordance with the present invention.

Referring now to FIG. 7, a first embodiment of the solenoid activation circuit 70 will be explained. In this embodiment, a full wave bridge rectifier 82 includes diodes D1, D2, D3 and D4. The AC electrical activation signal is passed to rectifier 82 at a pair of input terminals 78 connected to the anodes of diodes D3 and D4. A pair of output terminals located at the anodes of diodes D1 and D2 and cathodes of diodes D3 and D4 provide DC current for the timing circuit 86. The solenoid power circuit 90 is composed of resistors R1 and R2, capacitor C1 and silicon controlled rectifiers Q1 and Q2. The anodes of SCR's (silicon controlled rectifiers) Q1 and Q2 are electrically connected to the input terminals of the rectifier 82. The resistor R2, capacitor C1 and diode D6 are electrically connected to the output terminals of the rectifier 82 and provide gate current for SCR's Q1 and Q2 which in turn controls current flow through Q1 and Q2. The timing circuit 86 is composed of resistors R3, R4, R5 and R6, capacitor C2 and transistor Q3 and is also electrically connected to the output terminals of the rectifier 82. When an AC electrical activation signal from the activation means 74 is received at the input of the rectifier 82, a DC current begins to flow from the output terminals of the rectifier 82. If a positive half cycle is starting at the anode of D4, the voltage will be increasing with respect to the voltage at the anode of D3. As soon as the voltage is greater than the sum of the residual voltage on C1, the forward-bias voltages of D4 and D6 and the gate-bias voltage of Q2, current will begin to flow through D4, R2 and C1. At this time Q3 in the timer circuit is in a high impedance state which causes the current to flow through D6 thereby gating Q2 into conduction until the end of the half cycle and thereby activating the solenoid 18. The process is repeated such that Q1 is gated into conduction thereby continuing the activation of the solenoid 18. During this same time interval, current is also flowing in the timer circuit 86. As the charge on C2 increases, the voltage at the base of transistor Q3 increases until Q3 is biased "ON". When Q3 is "ON" it is in a low impedance state and begins to conduct. When Q3 is in full conduction the gate voltage of Q1 and Q2, is not sufficient to turn them on, thus current flow to the solenoid 18 is stopped. Q3 will remain in conduction as long as an AC electrical signal is received from the activation means 74. The component values chosen for the timing circuit 86 will determine the length of time for an active phase in which the solenoid is activated. A blocking phase in which the solenoid is not activated starts as soon as Q3 is in full conduction and continues until the AC electrical activation signal from the activation means 74 is discontinued. After the blocking phase is discontinued, R6 allows the voltage at the base of Q3 to bleed off, thereby resetting the active phase time for the next AC electrical activation signal from the activation means 74. Thus, as soon as the AC electrical activation signal from the activation means 74 is discontinued, the solenoid activation circuit 70 is immediately ready to receive and process the next AC electrical signal from the activation means 74.

Figure 8:
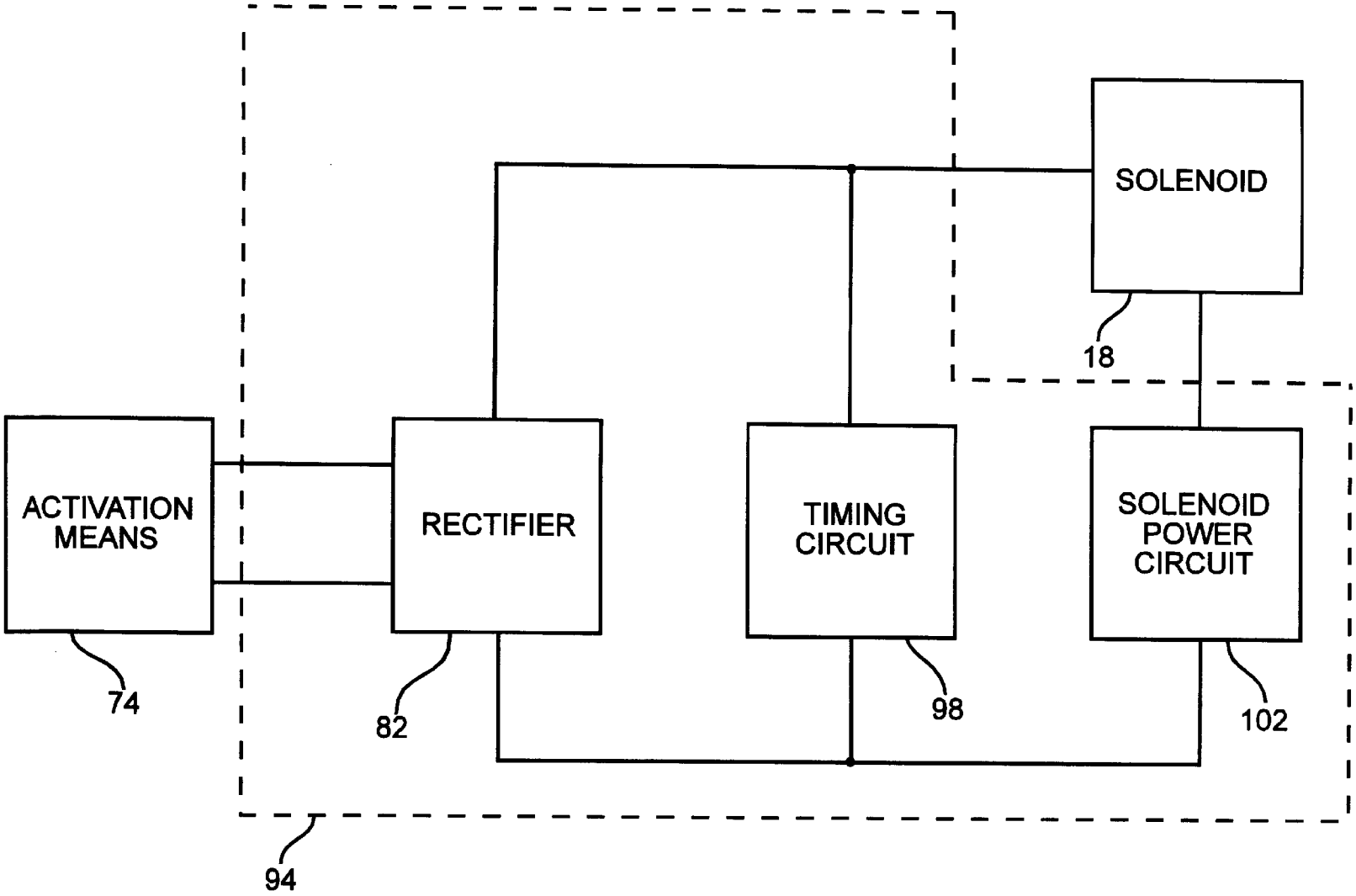
FIG. 8 is a block diagram of a second embodiment of a solenoid activation circuit in accordance with the present invention.
Figure 9:
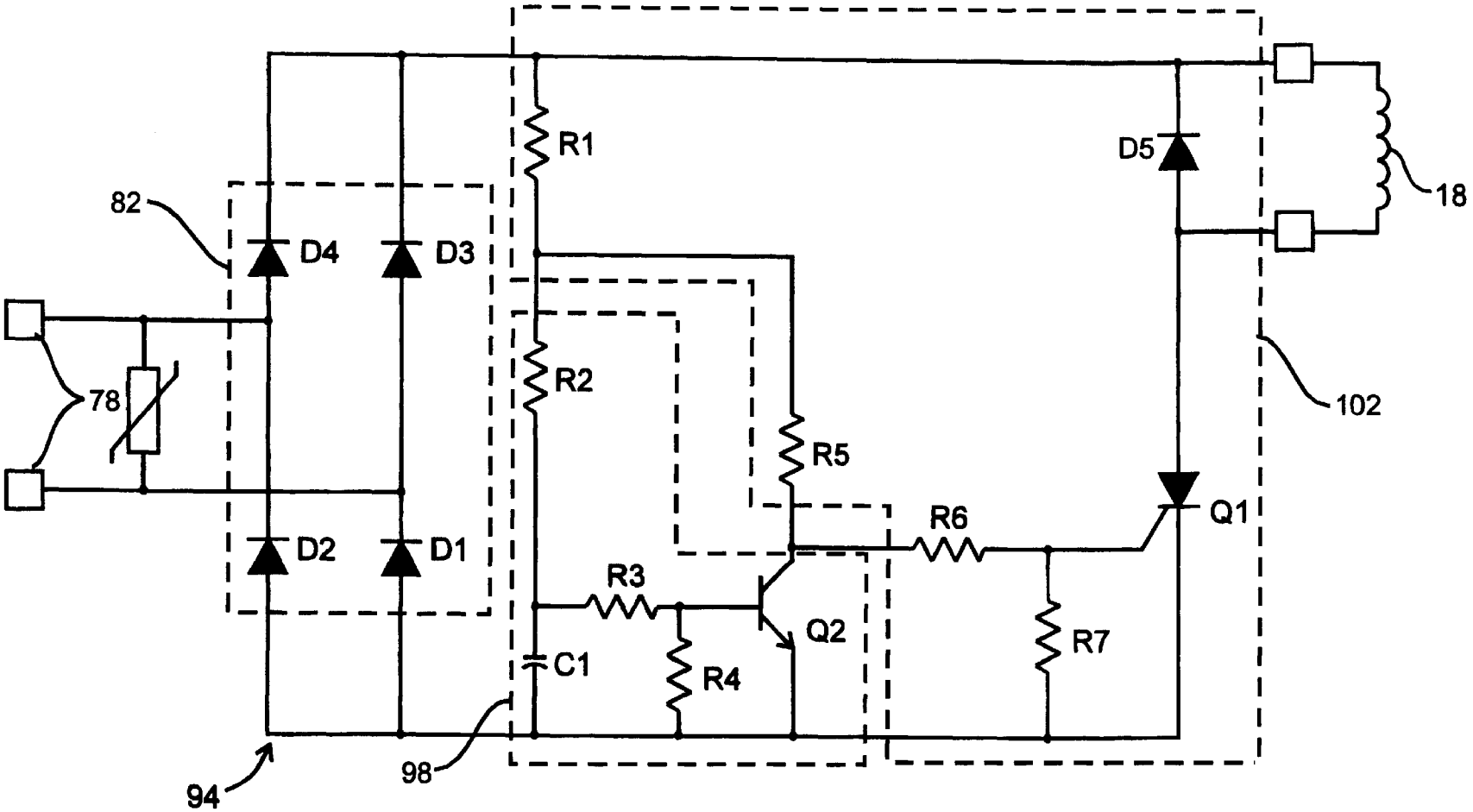
FIG. 9 is a circuit diagram of the second embodiment of a solenoid activation circuit in accordance with the present invention.

FIG. 8 is a block diagram of a second embodiment of a solenoid activation circuit generally indicated by reference numeral 94. In this embodiment the activation means 74 and rectifier 82 are comprised of the same elements as those in the first embodiment. As shown in FIG. 9, a timer circuit 98 is electrically connected to the outputs of rectifier 82 comprises resistors R2, R3 and R4, capacitor C1 and transistor Q2. A solenoid power circuit 102, including resistors R1, R5, R6 and R7, free wheeling diode D5 and a silicon controlled rectifier Q1, is also electrically connected to the outputs of the rectifier 82 and to the timer circuit 98. When an AC electrical activation signal is received from the activation means 74, current flows through resistors R1, R5, and R6 biasing the gate of Q1 such that Q1 goes into conduction, thereby causing current to flow through the solenoid 18. Current is also flowing through resistor R2, causing capacitor C1 to charge. As the charge on C1 increases, the base-bias voltage on Q2 also increases. When the base-bias voltage is sufficient, Q2 will conduct, causing current to flow through Q2, thereby decreasing the gate current of Q1 and causing Q1 to become ungated. Current will continue to flow through Q1 until the free wheeling current of solenoid 18 and free wheeling diode D5 has dropped to zero. The values of the timing circuit 98 components are chosen such the time required for the base-bias voltage of Q2 to cause conduction of Q2 is sufficient for the solenoid 18 to perform its intended duty.

Figure 10:
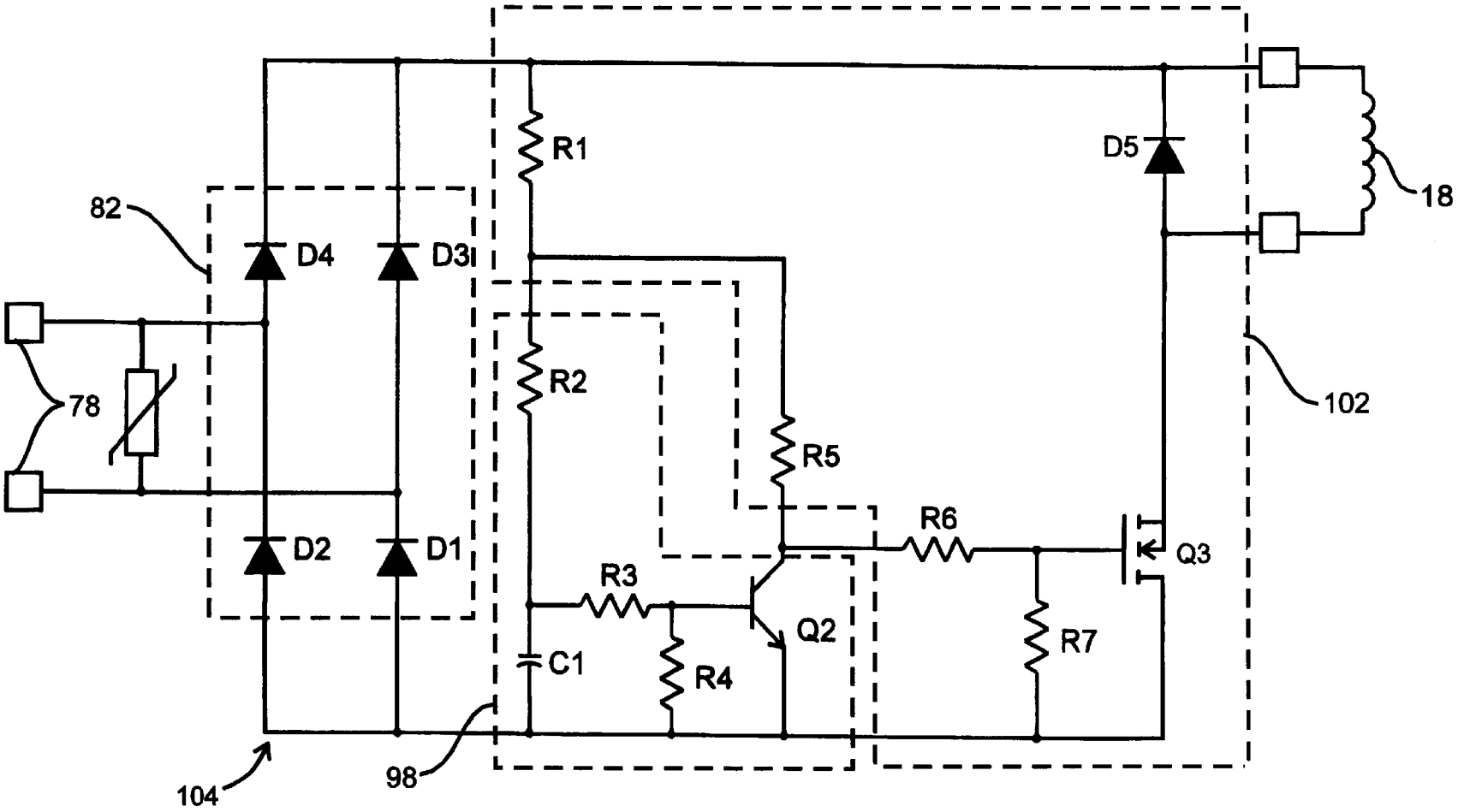
FIG. 10 is an alternate circuit diagram of the second embodiment of a solenoid activation circuit in accordance with the present invention.

An alternate solenoid activation circuit 104 is shown in FIG. 10. This embodiment is the same as shown in FIG. 9 except that an enhancement mode MOSFET Q3 replaces the SCR Q1 of FIG. 9. The MOSFET Q3 provides an immediate shutoff of power to the solenoid 18 when transistor Q2 starts conducting. The SCR of FIG. 9 will continue to conduct for a short time until free wheeling current has dropped to zero.

We claim:

1. A solenoid operated remote resetting device for an electrical overload protection device having a manual reset mechanism, said resetting device comprising:

a housing defining a hollow interior and further defining a generally rectangular opening for communication between said hollow interior and the outside of said housing;

a solenoid being enclosed within said housing, said solenoid having a movable plunger;

a printed circuit board enclosed within and held in fixed relationship to said hollow interior of said housing;

a solenoid activation circuit mounted on said printed circuit board, said solenoid activation circuit including a rectifier having two input terminals and a solenoid power circuit having a pair of silicone controlled rectifiers, each of said silicone controlled rectifiers being connected to one of said input terminals for alternately providing power to said solenoid during alternating half cycles of an unrectified alternating current at said input terminals, said solenoid activation circuit being activatable in response to a signal from a remote activating means, the remote activating means signal providing operating power for said solenoid activation circuit, said solenoid activation circuit providing operating power to said solenoid for a preselected length of time not determined by the length of time said solenoid activation circuit is receiving the remote activation signal;

a mechanical operator attached to said movable plunger for common movement thereof, said mechanical operator having an operating arm extending outwardly through said rectangular opening in said housing for engaging the manual reset mechanism of the electrical overload protection device; and means for mounting said housing securely on an outside surface of the electrical overload protection device such that said operating arm, when operated, will engage the manual reset mechanism.

2. The solenoid operated remote resetting device of claim 1 wherein said solenoid activation circuit further includes a timing circuit receiving DC power from a pair of output terminals of said rectifier.

3. The solenoid operated remote resetting device mechanical operator of claim 1 wherein said pair of input terminals receive said signal from said remote activating means.

4. The solenoid operated remote resetting device of claim 2 wherein said timing circuit is electrically coupled to said solenoid power circuit such that an active phase and a blocking phase are produced after each activation of said solenoid activation circuit.

5. The solenoid operated remote resetting device of claim 4 wherein said active phase is equal in length to said preselected length of time.

6. The solenoid operated remote resetting device of claim 5 wherein said timing circuit determines said preselected length of time.

7. The solenoid operated remote resetting device of claim 6 wherein said solenoid power circuit provides power to the solenoid during said active phase.

8. The solenoid operated remote resetting device of claim 4 wherein said solenoid power circuit does not provide power to the solenoid during said blocking phase.

9. The solenoid operated remote resetting device of claim 1 wherein said mechanical operator is movable with respect to said housing.

10. The solenoid operated remote resetting device of claim 9 wherein said mechanical operator is linearly movable between a first position and a second position.

11. The solenoid operated remote resetting device of claim 10 wherein said operating arm, when activated, causes the manual reset mechanism of the electrical overload protection device to be moved linearly from a first tripped position to a second resetting position thereby resetting the electrical overload protection device such that it can detect a fault condition and initiate a trip.

12. The solenoid operated remote resetting device of claim 1 wherein said housing defines a pair of oppositely extending ribs which can be slidingly received in complementary slots defined in an outside surface of the electrical overload protection device for proper alignment and mounting of said solenoid operated remote resetting device.

13. A solenoid operated remote mechanical operator comprising:

a housing;

a solenoid enclosed within said housing and having a plunger selectively movable between a first position and a second position;

a mechanical operator movably enclosed within said housing such that an operating arm of said mechanical operator extends through said housing and is movable with respect to said housing; and a solenoid activating circuit enclosed within said housing and being electrically connected to said solenoid, said solenoid activating circuit including a rectifier having two input terminals and a solenoid power circuit having a pair of silicone controlled rectifiers, each of said silicone controlled rectifiers being connected to one of said input terminals for alternately providing power to said solenoid during alternating half cycles of an unrectified alternating current at said input terminals, said solenoid activating circuit being activated in response to a signal from a remote activating means, the remote activating means signal providing operating power for said solenoid activation circuit, said solenoid activation circuit providing operating power to said solenoid for a preselected length of time not determined by the length of time said solenoid activation circuit is receiving the remote activating means signal.

14. The solenoid operated remote mechanical operator of claim 13 wherein said mechanical operator is attached to said solenoid plunger and is selectively movable between a first position associated with said first position of said plunger and a second position associated with said second position of said plunger.

15. The solenoid operated remote mechanical operator of claim 13 wherein said solenoid activation circuit further includes a timing circuit.

16. The solenoid operated remote mechanical operator of claim 15 wherein said rectifier has a pair of output terminals for providing DC power to said timing circuit.

17. The solenoid operated remote mechanical operator of claim 15 wherein said timing circuit is electrically coupled to said solenoid power circuit such that an active phase and a blocking phase are produced after each activation of said solenoid activation circuit.

18. The solenoid operated remote mechanical operator of claim 17 wherein said active phase is equal in length to said preselected length of time.

19. The solenoid operated remote mechanical operator of claim 18 wherein said timing circuit determines said preselected length time.

20. The solenoid operated remote mechanical operator of claim 19 wherein said solenoid power circuit provides power to the solenoid during said active phase.

21. The solenoid operated remote mechanical operator of claim 19 wherein said solenoid power circuit does not provide power to the solenoid during said blocking phase.

22. The solenoid operated remote mechanical operator of claim 13 wherein said means of activation is a manually operated operator interface device.

23. The solenoid operated remote mechanical operator of claim 13 wherein said means of activation is a PLC (programmable logic controller).

24. A solenoid operated remote resetting device for an electrical overload protection device having a manual reset mechanism, said resetting device comprising:

a housing defining a hollow interior and further defining a generally rectangular opening for communication between said hollow interior and the outside of said housing;

a printed circuit board enclosed within and held in fixed relationship to said hollow interior of said housing;

a solenoid being mounted on said printed circuit board, said solenoid having a movable plunger;

a solenoid activation circuit mounted on said printed circuit board, said solenoid activation circuit including a rectifier having two input terminals and two output terminals, a solenoid power circuit connected between said two output terminals and having an electronic switch connected between said solenoid and one of said output terminal, and a timing circuit connected between said two output terminals and having a controlling connection to said electronic switch, a signal from a remote activating means providing power to said solenoid activating circuit and said solenoid through said two input terminals;

a mechanical operator attached to said movable plunger for common movement thereof, said mechanical operator having an operating arm extending outwardly through said rectangular opening in said housing for engaging the manual reset mechanism of the electrical overload protection device; and means for mounting said housing securely on an outside surface of the electrical overload protection device such that said operating arm, when operated, will engage the manual reset mechanism.

25. The solenoid operated remote mechanical operator of claim 24 wherein said electronic switch is a silicon controlled rectifier having its gate controlled by said timing circuit.

26. The solenoid operated remote mechanical operator of claim 25 wherein said electronic switch is an enhancement mode MOSFET having its gate controlled by said timing circuit.

* * * * *